United States Patent [19]

Payne

[11] Patent Number: 4,968,267

[45] Date of Patent: Nov. 6, 1990

[54] PROGRAMMABLE MICROCONTROLLER MICROBUS CONNECTOR ARRANGEMENT

[75] Inventor: Peter P. Payne, Bloomington, Minn.

[73] Assignee: Honeywell Inc., Minneapolis, Minn.

[21] Appl. No.: 368,924

[22] Filed: Jun. 19, 1989

Related U.S. Application Data

[63] Continuation of Ser. No. 192,457, May 11, 1988, abandoned.

[51] Int. Cl.[5] ..... H01R 4/24

[52] U.S. Cl. ..... 439/410; 439/404; 439/488; 439/529

[58] Field of Search ..... 439/389, 391–395, 439/404–410, 191–194, 207, 208, 488, 529

[56] References Cited

U.S. PATENT DOCUMENTS

| | | | |
|---|---|---|---|
| 2,930,021 | 3/1960 | Hasselhorn et al. | 439/413 |
| 3,646,285 | 2/1972 | Farrell et al. | 439/417 |
| 4,047,787 | 9/1977 | Gumb et al. | 439/638 |
| 4,162,815 | 7/1979 | Fleischhacker | 439/502 |
| 4,533,199 | 8/1985 | Feldberg | 439/404 |
| 4,536,050 | 8/1985 | Hung | 439/404 |
| 4,537,456 | 8/1985 | Brown et al. | 439/404 |
| 4,621,398 | 11/1986 | Kleiman | 439/191 |
| 4,653,829 | 3/1987 | LaMont | 439/576 |

*Primary Examiner*—David L. Pirlot

*Attorney, Agent, or Firm*—Robert B. Leonard; Donald J. Lenkszus

[57] ABSTRACT

A connector arrangement for an electronic controller includes a plurality of insulation displacement terminals. The connector has a body portion and cover portion. The cover portion includes tabs which will force a wire onto the insulation displacement terminal so that electrical connectors are made. In one embodiment, the connector is connected to a standard phone cable which, in turn, terminates in a modular phone plug.

7 Claims, 6 Drawing Sheets

PROGRAMMABLE MICROCONTROLLER MICROBUS CONNECTOR ARRANGEMENT

This application is a continuation, of application Ser. No. 07/192,457, filed May 11, 1988 now abandoned.

Background of the Invention

The present invention pertains to a wiring assembly which combines electrical wiring and pneumatic tubing into one bundle, and a connector arrangement for taping into the electrical wiring.

Modern heating, ventilating, and air-conditioning (HVAC) systems are more and more becoming controlled by means of electronic and microprocessor controllers. This requires that new and improved arrangements for establishing transmission of communication and power signals to remote electronic and microprocessor control devices associated with the HVAC systems also b provided. Furthermore, with the increasing cost of labor in installation of systems, it is important that arrangements be provided in which installation times can be significantly reduced.

Summary of the Invention

In accordance with the principles of the invention, a connector arrangement is provided for establishing electrical connections to a plurality of insulated conductors in one simultaneous operation. More specifically, in accordance with the principles of the invention, a connector includes a plurality of insulation displacement terminals for engaging the insulated conductors and each of the insulation displacement terminals is connected to one wire of a multiple conductor cable assembly which terminates in a modular plug.

In one embodiment of the invention, the connector includes an opening which is used to capture a pneumatic line. In that embodiment it is anticipated that the wires to which the connector will connect are wrapped around, or placed in close proximity to the pneumatic line.

In a second embodiment in accordance with the principles of the invention the pneumatic line includes an integrally formed second tube which is slit along its length to function as a cable jacket for the insulated conductors.

Brief Description of The Drawing

The invention will be better understood from a reading of the following detailed description taken in conjunction with the drawing in which:

FIG. 7 is a bottom view of the cover portion of the connection of FIGS. 3 to 6.

Detailed Description

Figure 1:
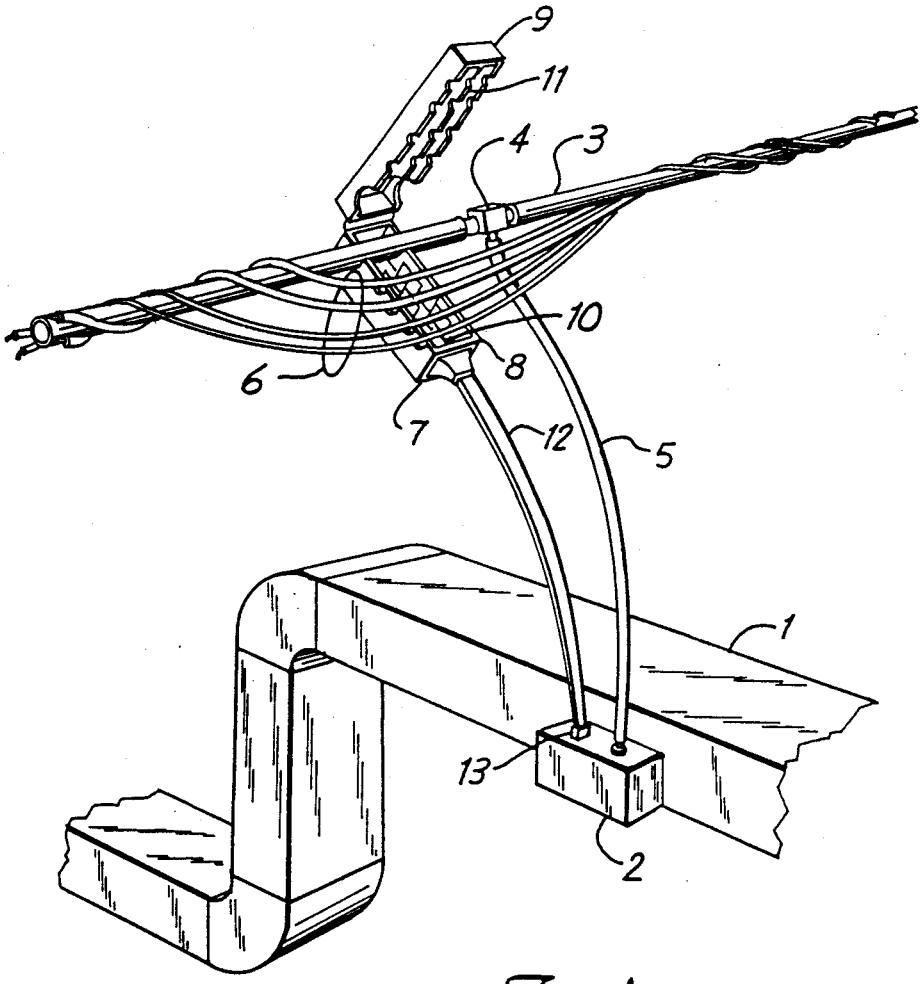
FIG. 1 is a perspective view of a control and connector arrangement in accordance with the principles of the invention.

In FIG. 1, a portion of a duct 1 of heating, ventilating, and air-conditioning (HVAC) system is shown. Attached to duct 1 is a controller 2. The controller 2 is connected to a pneumatic line via a "T" connector 4 and 5. Wrapped on pneumatic tube 3 is power and communication bus 6. The power and communication bus 6 includes four insulated electrical conductors. Electrical connection to the conductors of bus 6 is provided by means of a connector and cable assembly 7.

The connector portion of assembly 7 comprises a connector body portion 8 and a conductor cover portion 9.

Each of the four conductors of the bus 6 is routed through a pair of channels on opposite side walls of the body portion 8. In line with each pair of channels in the side walls of body portion 8, and supported in the body portion 8 is an insulation displacement terminal. Each wire of the bus 6 is laid across an insulation displacement terminal and through the corresponding channels in the side walls of the body portion 8.

Additionally, the body portion 8 includes a pair of channels which are sized to engage the pneumatic tubing 3. Cover portion 9 includes an engagement tab or tabs 11 which has notches sized to engage the wires of bus 6. Additionally, the side walls of cover 9 include pairs of channels sized to engage each of the wires of bus 6, and a further pair of channels to engage the pneumatic tube 3.

When cover 9 is pressed downward into engagement with body portion 10 the tab or tabs 11 force the wires of bus 6 onto the insulation displacement terminals to establish electrical connections thereto. Additionally, the pneumatic tube is captured between the cover portion 9 and the bottom portion 8 of the connector.

Each of the insulation displacement terminals is connected to one wire of a four conductor cord 12. The other end of the cord 12 terminates in a standard modular plug 13 which mates with a corresponding modular socket which is carried on the controller 2.

Figure 2:
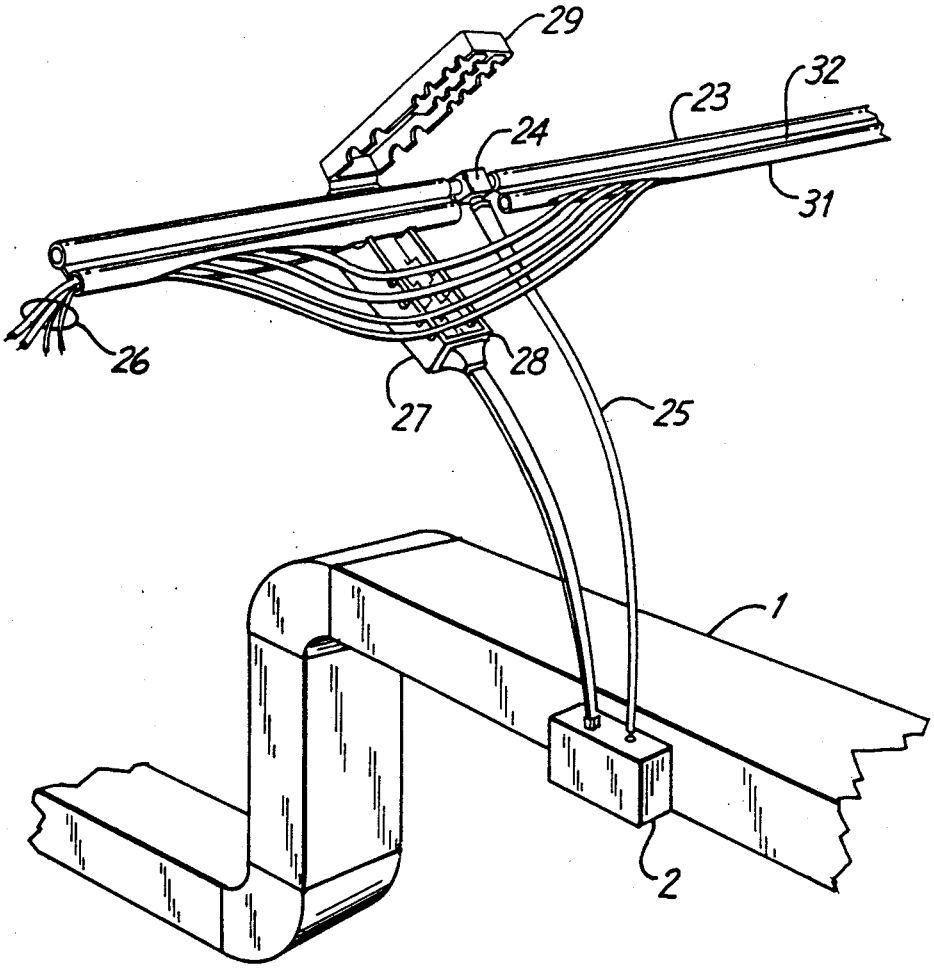
FIG. 2 is a perspective view of a second embodiment of a control and connector arrangement in accordance with the principles of th invention.

Turning now to FIG. 2, once again a portion of a duct 1 is shown having a controller 2 disposed thereon. A polyethylene pneumatic tube 23 is connected to the controller 2 by means of a pneumatic connector 24 and pneumatic tube 25. Electrical connections to the controller 2 from a bus 26 having four insulated electrical conductors is provided by means of a connector and cable assembly 27. The connector and cable assembly 27 as shown in FIG. 2 is similar to that shown in FIG. 1 with the exception that the pneumatic tube 23 includes an integrally formed second web 31 which is connected to the tube 23 by means of a web 32. Tube 31 has a longitudinal slit which permits the tube 31 to be opened and bus 26 inserted therein.

Connector 27 includes a second pair of notches in its body portion 28 and cover portion 29 which are sized to engage the tube 31.

FIGS. 3 to 7 show a connector and cable assembly which instead of hanging on the pneumatic tube as the two foregoing embodiments may be securely fastened to a mounting place by means of a conventional fastener such as a screw or the like.

Figure 3:
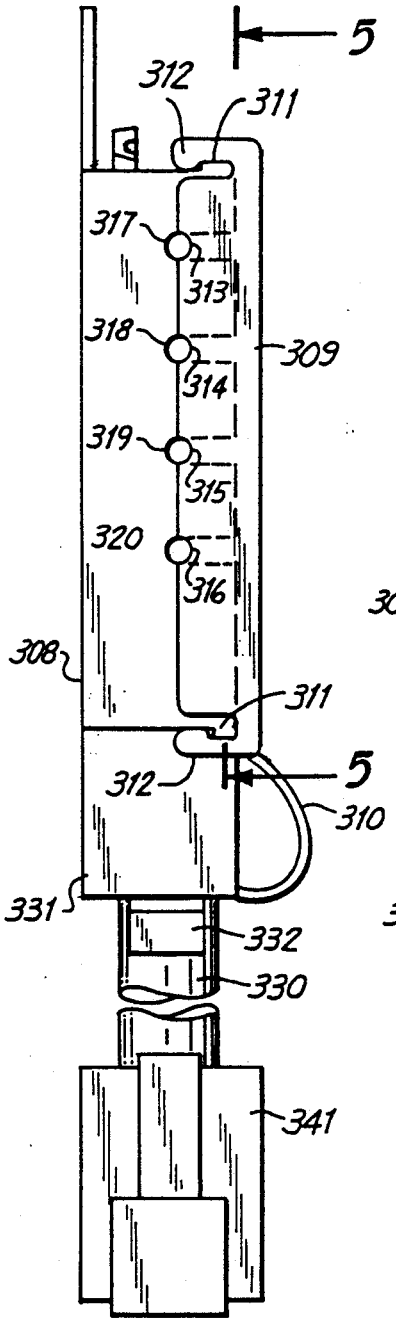
FIG. 3 and 4 are side views of a connector in accordance with the principles of the invention.
Figure 4:
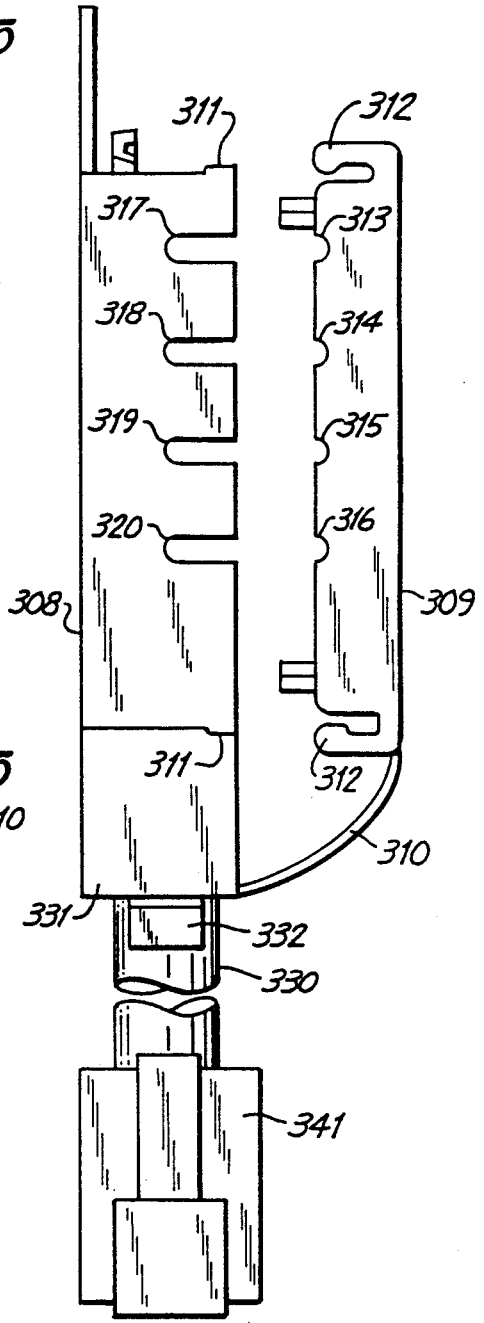

The connector and cable assembly includes a body portion 308 and a cove portion 309. In Figure 3, the cover portion is shown in engagement with body portion 308 wherein FIG. 4 the cove portion 309 is shown separated from body portion 308. The cover portion 309 is attached to body portion 308 by means of a flexible hinge 310. Body portion 308 includes projecting tabs 311 at both ends thereof, over which lips 312 of cover 309 snap into position to retain cover 309 on the body portion 308.

Body portion 308 includes pairs of channel 317, 318, 319, 320 and cover portion 309 includes corresponding pairs of channels 313, 314, 315, 316.

Figure 5:
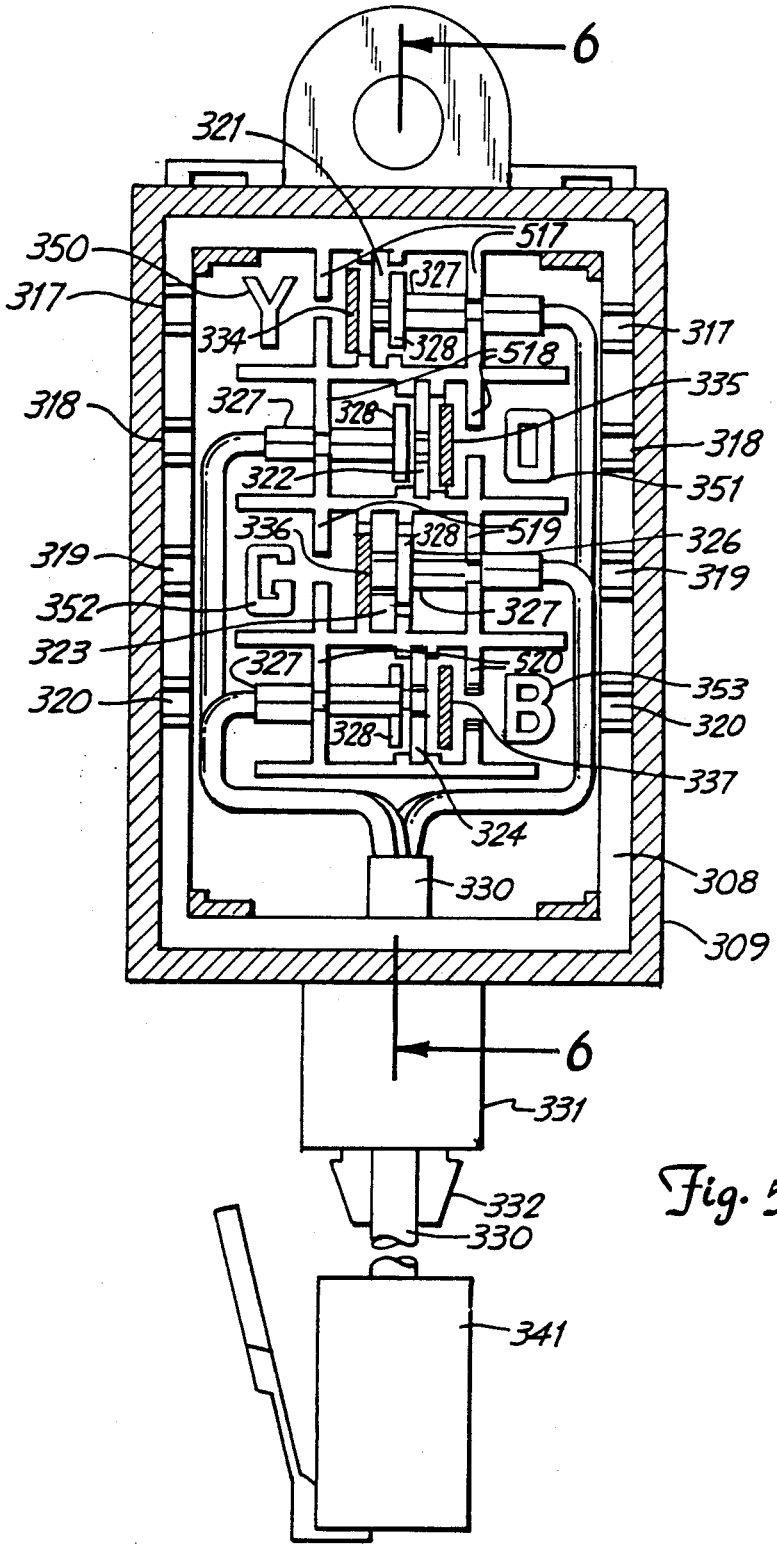
FIG. 5 is a top cross sectional view of FIG. 3 taken along the lines 5–5.
Figure 6:
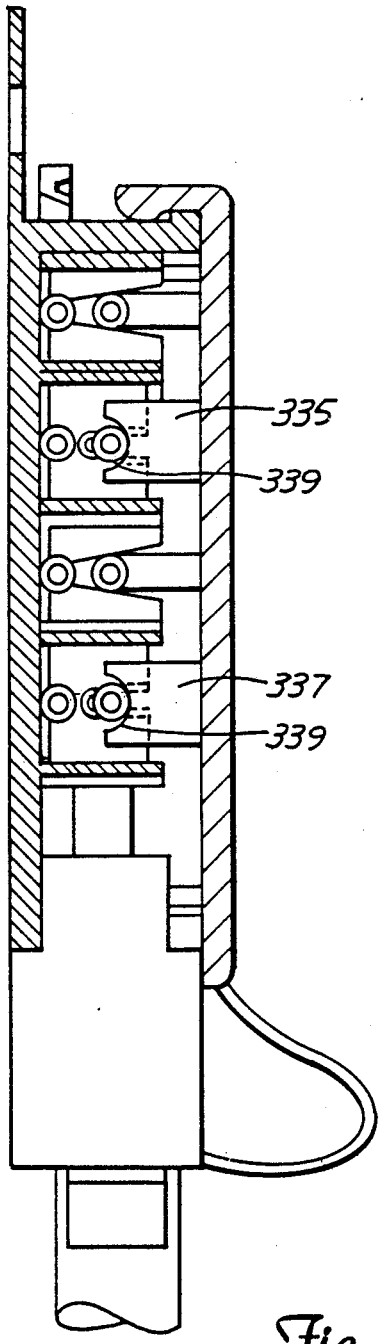
FIG. 6 is a side cross-sectional view taken along lines 6–6 of FIG. 5.

As more clearly seen in FIG. 5, each pair of channels is in longitudinal alignment with a pair of wire guides 517, 518, 519, 520, which are integrally formed on the body portion 308. Each pair of wire guides 517, 518, 519, 520 includes a channel for receiving a wire or insulated conductor. Insulation displacement terminals 321, 322, 323, 324, are each captured between pairs of channels formed in the body portion 308 and positioned between respective pairs of wire guides 517, 518, 519, 520. Each insulation displacement terminal 311, 312, 313, 314, is connected to one wire of a of four conductor phone cable 330 by means of crimp connections 327. Each crimp connection is retained in position by a corresponding one of the wire guides 517, 518, 519, 520. Tabs 328 on each crimp connection likewise help to retain the crimp connection and insulation displacement tabs in position.

The body portion 308 includes a strain relief ring 331 connected thereto, and a strain relief tab 2 inserted in the strain ring 331. The strain relief tab 332 secures cable 330 to the body portion 8. The cable 330 terminates in a conventional modular plug 341.

The cover 309 includes integrally formed engagement tabs projecting from the inside of cover 309. Each of the tabs 334, 335, 336, 337, includes a recess 9 at its end most clearly shown in FIG. 6.

Cover portion 309 further includes alignment guides 340 which guide the cover into body portion 308. The position of guides 340 is most clearly shown in FIG. 7.

In using the structure shown of FIGS. 3 to 7, each of four insulated conductors is placed in a corresponding pair of the channels 313, 314, 315, 316, of body portion 308. Each such insulated conductor will also be positioned in the channels of the corresponding pair of wire guides 317, 318, 319, 320 and also in the channel of the corresponding insulation terminal 321, 322, 323, 324 as cover 309 is snapped onto body portion 308 the engagement tabs 334, 35, 336, 337, onto the insulation displacement terminals causing the insulation to be displaced and electrical contact to be made.

Body portion 308 further includes an integrally formed mounting tab 360 which has an aperture 342 form therein permitting the assembly to be securely fastened by means of a screw or bolt to a mounting surface. The body portion 308 also includes integrally formed tie-wrap retainers 343.

To avoid confusion in installation, the body portion 308 includes insulation color codes 350, 351, 52, 353, integrally formed on body portion 308.

In the illustrative embodiment shown in FIGS. 3 to 7 the assembly shown is both water and dust resistant. The insulation displacement terminals are of known type and may be sized for any standard gauge of wire but in the illustrative embodiment are designed for use with 18 gauge standard wire.

The insulator displacement terminals are blades having a center notch of a width slightly less than the diameter of the conductor. The sides of the notch are tapered to form nearly parallel opposing surfaces. As wire is forced down in the center notch, the opposing surfaces will displace the insulation and will engage the conductor.

The crimp connections are, however, designed for standard size wire used in conventional commercially available cable assemblies.

The connector of any of the three embodiments may be directly mounted onto a controller board or on its housing with such an arrangement, the cable connector may be eliminated and the insulation displacement terminals may be extended through the housing base and be shaped such that they may be used as printed circuit board terminals with the connector being attached to a printed circuit board by wave-soldering or other connecting methods.

I claim:

1. Control apparatus comprising:

a pneumatic line;

a bus comprising a plurality of insulated conductors, said bus extending in a direction generally parallel to said pneumatic line, said bus being continuously accessible for electrical connection;

a connector including a body portion, a cover portion, a plurality of insulation displacement terminals supported in said body portion and engagement means carried by said cover portion, said insulated conductors of said bus being individually placed on said insulation displacement terminals, said engagement means being adapted to force said insulated conductors onto said insulation displacement terminals to displace insulation on said insulated conductors and to make electrical connections to said controller, said connector including means for capturing a portion of said line; and means connecting said controller to said connector.

2. Apparatus in accordance with claim 1 wherein:

said pneumatic line is polyethylene.

3. Apparatus in accordance with claim 1 comprising:

means integrally formed with said pneumatic line for carrying said bus,

4. Apparatus in accordance with claim 3 wherein:

said pneumatic line and said carrying means are of polyethylene.

5. Apparatus in accordance with claim 3 wherein:

said connector further includes means for capturing a portion of said carrying means.

6. Apparatus in accordance with claim 1 comprising:

a tube integrally formed with said pneumatic line and having a longitudinal slot;

said bus being carried in said tube.

7. Apparatus in accordance with claim 2 wherein:

said connector further includes means for capturing a part of said tube.

* * * * *